United States Patent [19]

Stumpf

[11] 4,054,317

[45] Oct. 18, 1977

[54] CHAIR CONSTRUCTION

[75] Inventor: William E. Stumpf, Winona, Minn.

[73] Assignee: Herman Miller, Inc., Zeeland, Mich.

[21] Appl. No.: 648,796

[22] Filed: Jan. 13, 1976

[51] Int. Cl.[2] ..... A47C 3/00

[52] U.S. Cl. ..... 297/297; 297/349; 297/416; 297/451

[58] Field of Search ..... 297/349, 296, 297, 451, 297/416, 298

[56] References Cited

U.S. PATENT DOCUMENTS

| | | | |
|---|---|---|---|
| 2,054,557 | 9/1936 | Cramer et al. | 297/349 X |
| 3,241,884 | 3/1966 | Thatcher et al. | 297/451 X |
| 3,294,441 | 12/1966 | Ciuffini et al. | 297/296 |
| 3,749,192 | 7/1973 | Karchak, Jr. et al. | 297/416 X |
| 3,851,920 | 12/1974 | Harris et al. | 297/451 X |
| 3,910,633 | 10/1975 | Marsh | 297/349 |

FOREIGN PATENT DOCUMENTS

| | | | |
|---|---|---|---|
| 809,234 | 7/1949 | Germany | 297/297 |

*Primary Examiner*—Roy D. Frazier
*Assistant Examiner*—Darrell Marquette
*Attorney, Agent, or Firm*—Price, Heneveld, Huizenga & Cooper

[57] ABSTRACT

A basic chair frame is disclosed consisting of a minimum number of interchangeable components including a seat/back frame member, a spindle attachment plate a seat shell and an anti-racking attachment for arm members. Because the several parts are reduced in design and construction to basic essentials by means of interchange of components the frame can be modified to adapt the chair to a variety of disparate uses.

7 Claims, 6 Drawing Figures

CHAIR CONSTRUCTION

BACKGROUND OF THE INVENTION

This invention relates to seating of the type normally used by secretaries, accountants and executives in the commercial, industrial and professional fields. The numerous activities encountered in these various phases of activity require a number of different types of seating. Further, the human anatomy is such that no one particular seat design or construction normally will satisfy the needs of more than a portion of the potential users. To make matters more complex, people have a wide range of tastes and preferences. These tastes and preferences both from the standpoint of comfort and from the standpoint of appearance also become important factors in determining whether or not a particular seat is considered acceptable and whether or not, from the manufacturer's point of view, it enjoys any significant commercial success.

Because of a large number of disparate factors which enter into the acceptability of any particular type of commercial, industrial or professional seating, it has been standard practice to manufacture a number of different seat designs, each one of which is an individual product having neither functional nor structural interchangeability with other seating products. This results in excessive manufacturing costs as well as either large or costly inventories or long and frustrating delays in delivery of a product because it has to be specifically ordered and practically custom made, awaiting its turn on the production lines. This also results in early and costly obsolescence of the various components which enter into this type of seating.

SUMMARY OF THE INVENTION

The invention provides a chair having a de minimis frame consisting of only a few parts. With the substitution of one or two of the parts, the frame can be changed to accommodate the requirements of a wide variety of different uses.

The invention provides parts which are very simple and, thus, fundamental in both design and function. The interchanging of the parts can be accomplished using a single tool such as a wrench or a screw driver. The invention makes it possible to change a particular chair structure either at the factory or at the point of sale to readily and quickly adapt either its use or its styling or both to meet a customer's particular needs and tastes. This can be done by an interchange of components in which there is merely component substitution, those components which are removed being reusable in other chair assemblies. The invention provides a chair construction which may be equipped with arms or arms may be omitted. When arms are utilized, the assembly provides a positive anchoring for the arms which eliminates the conventional racking problems experienced in most chair constructions. Furthermore, arms of a wide variety of design, both functionally and aesthetically, can be used with the frame of this invention permitting the choice of function and/or aesthetic designs to be made by the customer and the chair assembled to satisfy the customer's needs at the point of sale.

DETAILED DESCRIPTION OF THE PREFERRED EMBODIMENT

Figure 5:
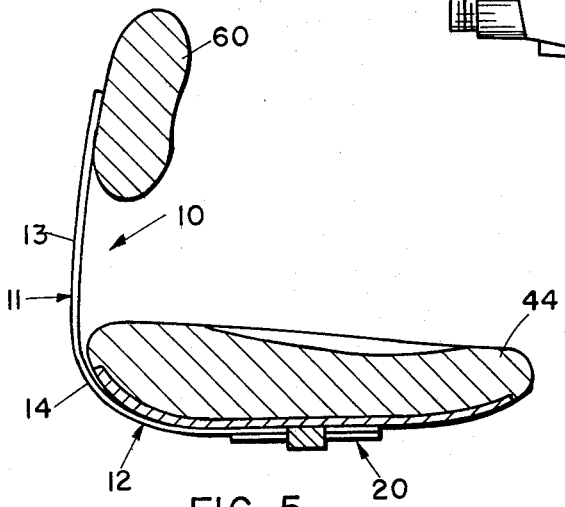
FIG. 5 is a sectional elevation view taken along the plane V—V of FIG. 1.
Figure 1:
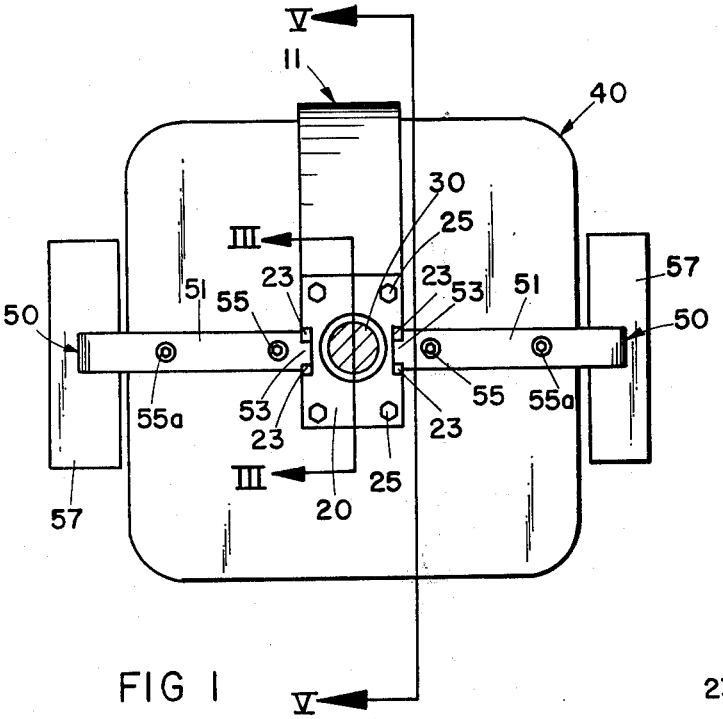
FIG. 1 is a bottom view of a chair frame incorporating this invention.
Figure 4:
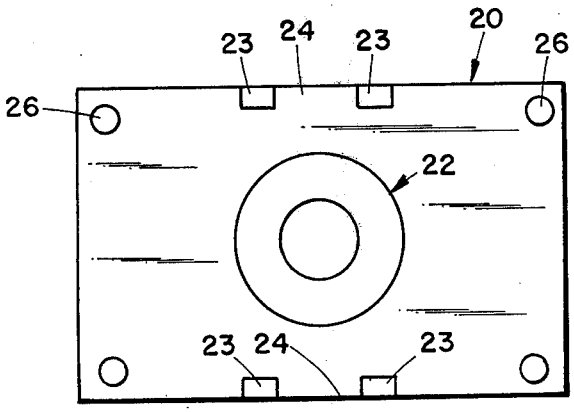
FIG. 4 is a bottom view of the spindle plate of this invention.
Figure 2:
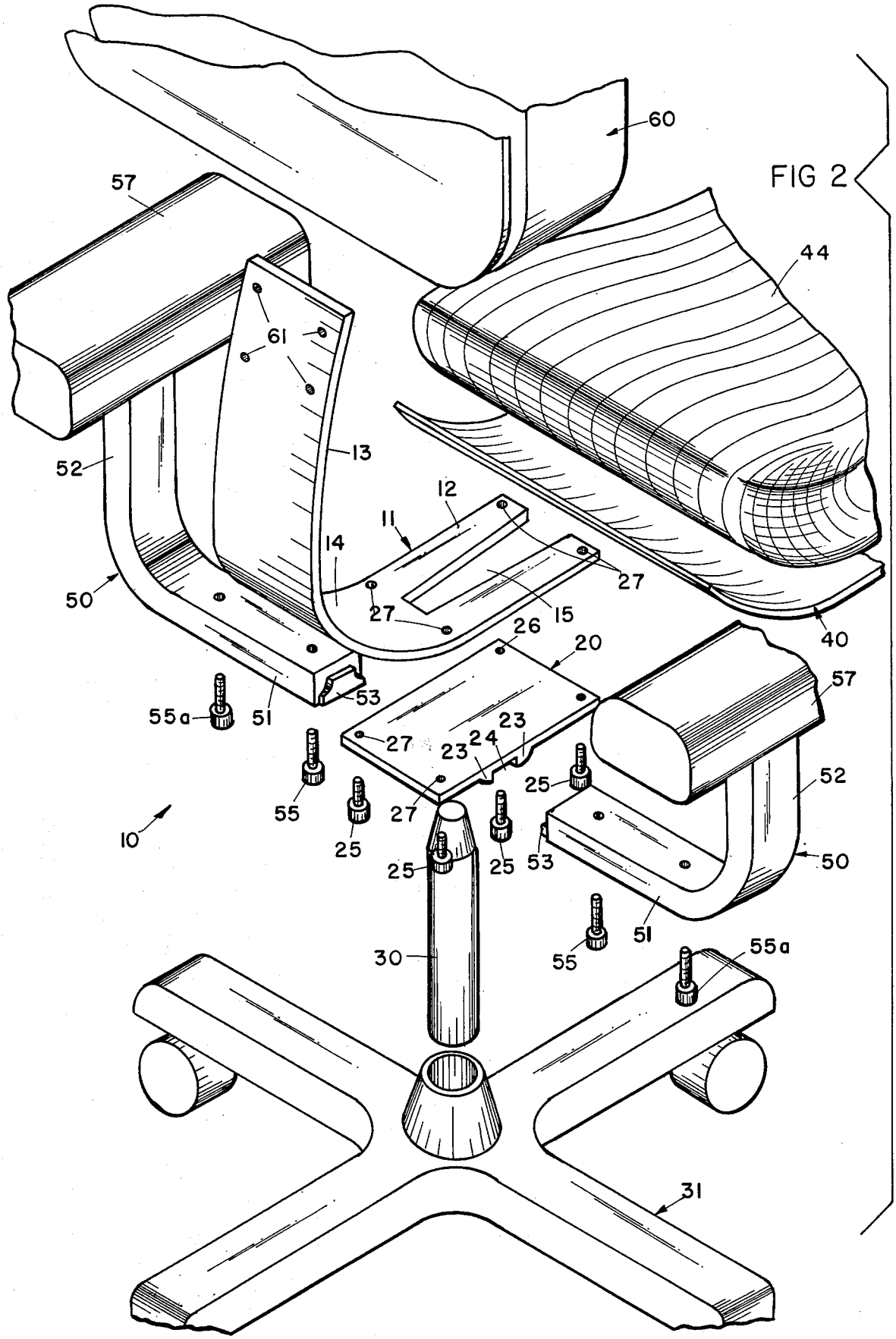
FIG. 2 is an enlarged, exploded view of the chair frame of this invention.

Referring to FIGS. 1, 2 and 5, the numeral 10 refers to a chair frame consisting of a single steel strap 11 having a seat portion 12 and back portion 13. The seat and back portions are substantially normal to each other and are joined by a curved portion 14 of substantial radius. The strap 11 is generally rectangular in overall shape and preferably consists of a single length of steel plate of a width which is a minor portion of the overall width of the chair. The thickness of the strap is such that it will withstand all expected usages without permanent deflection but will provide a degree of resilience to the back when the chair's occupant leans back against it. For this purpose, it has been determined that a strap consisting of 1045 spring tempered steel having a cross section of 0.25 × 4.00 inches has the required combination of characteristics. The forward end of the frame is bifurcated to provide the forwardly opening channel 15 (FIG. 2). The purpose of the channel will be explained subsequently.

The chair frame 10 is supported on a spindle plate 20. The spindle plate 20 has a rectangular slab 21 preferably of the same width as the strap 11. The spindle plate 20 seats against the lower face of the forward end of the chair strap 11 underlying the channel 15. Substantially at its center, the plate 20 has a depending spindle socket 22 having a central opening to receive the top end of the spindle 30. On each side socket 22, the plate has a pair of fore and aft spaced tongue guides 23 defining a tongue track 24 between them. The tongue tracks 24 are illustrated as aligned with the spindle socket 22. However, this is not essential since they may be located either fore or aft of the socket 22. The spindle plate can be assembled from separate components, as by welding, but preferably it is cast as a single piece.

The spindle plate 20 is attached to the strap 11 and to seat shell 40 by suitable fasteners 25 which are installed through the holes 26 in the spindle plate and holes 27 in the strap. The seat shell 40 is preferably of plywood but could be of molded plastic or of formed sheet metal. Depending upon the particular material from which the seat shell 40 is made, the fasteners may be of different types. In any case, a suitable type of threaded anchor such as T-nuts or weld-nuts for receiving the fasteners is provided so that installation of the fasteners will securely anchor the spindle plate 20 to the seat shell 40 with the chair frame 10 sandwiched between to produce a rigid assembly. When suitable threaded anchors such as T-nuts are used with plywood, the fasteners can be of the machine screw type such as cap screws. The seat shell 40 provides a base and rigid or substantially rigid support for the seat cushion 44. The cushion can be of any construction since the particular type of cushion involved is irrelevant to this invention.

The lower end of the spindle 30 is secured to a supporting base 31. The base can be of any suitable construction and the means of attachment of the spindle to the base can be of any of the various well-known constructions. The spindle can be of any of various well-known constructions. In some cases, the particular use to which the chair is to be put will determine the choice of the spindle construction. A preferable construction is one which permits both rotation and vertical adjustment of the type disclosed in co-owned patent application, Ser. No. 714,799 entitled *ADJUSTABLE STANDARD FOR SWIVEL CHAIR,* filed Aug. 16, 1976, a continuation of Ser. No. 648,795, filed Jan. 13, 1976, abandoned.

Arm brackets 50 extend from each side of the strap 11 and spindle plate 20. The arm brackets 50 each have an inner portion 51 contoured to seat against the lower surface of the seat shell 40 and an outer generally upright portion 52 extending upwardly and terminating at the top in a suitable mounting means for an arm rest pad 57. The specific pad mounting means is neither illustrated nor described since it can be any one of many conventional constructions and does not constitute part of this invention. While the arm brackets 50 are illustrated as being straight in a lateral direction, they can have other configurations such as extending forwardly or rearwardly at an angle to the chair frame or their configuration can be sinuous. The specific shape of the arm brackets does not affect this invention so long as the arm brackets 50 can be secured to the strap 11 and spindle plate 20 and seat shell 40 in the manner about to be described.

The inner ends of the arm brackets 50 each have a tongue 53 projecting from the end. The tongue 53 is spaced from the upper face of the arm bracket a distance equal to the combined thickness of strap 11 and the slab portion 21 of the spindle plate 20. This permits the tongue 53 to seat under the lower face of the spindle plate and in the tongue track 24 between the tongue guides 23. The tongues have a somewhat trapezoidal cross section to accommodate them to draft on the sides of the tongue guides when the latter are cast. The use of this taper or draft is not essential to the invention and could be eliminated, if the tongue track is machined to remove it. The important point is that at least some portion of the tongue 53 closely fit the tongue track to restrain the inner end of the arm bracket 50 against fore and aft movement. Outwardly of the spindle plate each of the arm brackets 50 is secured to the seat shell 40 by a pair of fasteners 55 and 55*a,* the fasteners 55 and 55*a* being spaced apart laterally of the chair. The fasteners 55 and 55*a* are similar to the fasteners 25. By positively locking the inner end of the arm brackets against fore and aft movement the racking action commonly experienced in arm brackets of conventional chair constructions is eliminated. The combination of the anchored tongue 53 and the fasteners 55 and 55*a* produces a force couple which is particularly effective in resisting rocking. Further, the design of the tongue interlock with the spindle bracket provides a universal means of stabilizing arm brackets of a wide variety of designs, thus, contributing materially to the interchangeability of the chair frame for a wide variety of disparate uses.

A back cushion 60 is secured to the upper end of the strap 11. The cushion 60 can be of any suitable construction and may be attached by any suitable means. It may be rigidly secured to the strap by fasteners mounted through the holes 61. Alternatively, it may be mounted by means which will afford it a limited degree of pivotal adjustment about a horizontal axis or of vertical adjustment along the strap or both.

Figure 6:
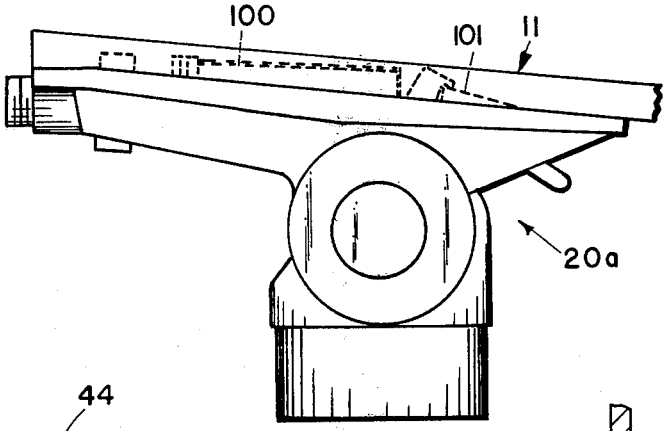
FIG. 6 is a sectional elevation view of the frame of the invention utilizing a modified spindle plate.
Figure 3:
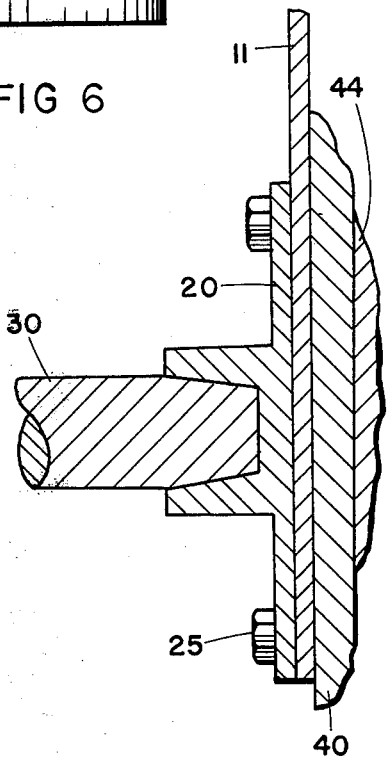
FIG. 3 is an enlarged, fragmentary, sectional view taken along the plane III—III of FIG. 1.

The provision of the channel 15 permits the strap 11 to be used with a spindle plate designed to permit tilting of the seat. When tilting is desired, the spindle plate 20 is replaced with a plate assembly 20*a* of the type disclosed in co-owned patent application, Ser. No. 648,793, entitled *MECHANISM FOR TILTING CHAIRS,* filed Jan. 13, 1976, now U.S. Pat. No. 4,018,415. The channel 15 provides space to accommodate the tension generating spring 100 and attitude control mechanisms 101 which project above the top surface of the spindle plate 20*a* (FIG. 6). To adopt the tilt plate disclosed in said application for utilization in this invention the only change necessary is the addition of the tongue guides 23 to create the tongue track 24.

It will be recognized that the back face of the back cushion 60 including its means of attachment to the strap 11 can be covered by a suitable cover to provide an aesthetically pleasing appearance. In like manner, a cover can be applied to the bottom surface of the seat shell 40 which can be sandwiched between both the strap 11 and the arms 50 and the shell 40. Since these covers are non-structural, they can be of thin plastic sheet material.

It will be seen that this invention provides a chair construction having a minimum number of parts and using a minimum amount of material. At the same time, it provides a basic frame construction in which the few essential parts are interchangeable to adapt the chair to a variety of different capabilities and conditions of usage. The invention also permits a wide variety of stylings to be obtained using a single basic frame construction. Thus, the invention affords substantial economics in manufacture and warehousing. It also is adapted to custom styling and appointment to satisfy individual custom tastes. This can be done either at the factory or at the point of sale by interchange of parts. The only tool necessary for doing this is a wrench or screw driver to manipulate the fasteners. Thus, the invention provides rapid styling at the point of sale, materially reduces the time lapse between customer selection and actual delivery. Also, important is the fact that should the customer, upon seeing the chairs in the environment in which they will be used, discover the styling choice was unsatisfactory, the problem can be rapidly corrected by an exchange of parts.

While a preferred embodiment of the invention has been disclosed and described, it will be recognized that modifications of the invention can be made. Such modifications as incorporate the principles of this invention are to be considered as included in the hereinafter appended claims unless these claims by their language expressly state otherwise.

The embodiments of the invention in which an exclusive property or privilege is claimed are defined as follows:

1. A chair frame having a seat and a back comprising: a narrow elongated strap member having a straight, forward seat portion and an upstanding back portion, said back and seat portions connected by an integral curved portion; a spindle plate underlying and seated against the forward part of said seat portion of said strap member; the forward portion of said strap being bifurcated and defining a channel opening through the forward end of said strap for accommodating a portion of a seat tilting mechanism projecting into the plane of the strap; said seat having a shell; fastener means detachably securing both said spindle plate and said strap to said seat shell; a pair of arm brackets; a pair of spaced, depending guide members on each side of said spindle plate, each pair forming a tongue track therebetween for detachably engaging the ends of said arm brackets; each of said brackets being generally L-shaped having an upstanding portion and a generally horizontal portion, the end of said horizontal portion having a tongue projecting from said end, said tongue being offset from the upper surface of said arm bracket an amount at least equal to the combined thickness of said strap and plate and of a width to be received in said tongue track and to slidably seat between said guide members for holding said ends against fore and aft movement.

2. The chair frame described in claim 1 wherein second fastener means are provided for detachably securing said arm brackets to said shell at points substantially laterally outwardly of said tongue guides and said first mentioned fastener means, and said tongue guides providing a support couple holding said arm brackets against fore and aft pivotal motion.

3. The chair frame described in claim 1 wherein each of said arm brackets has a portion adapted to seat against the lower face of said shell; the inner ends of said arm brackets abutting said spindle plate; said tongues closely fitting between said guide members.

4. The chair frame described in claim 1 wherein said strap and said spindle plate are of the same width, are superimposed, and said inner ends of said arm brackets abut the lateral edges of both said strap and spindle plate.

5. The chair frame described in claim 1 wherein said tongues are each offset from the upper surface of said arm brackets and define an upwardly and inwardly open pocket of a size to receive the combined edges of said strap and spindle plate.

6. A chair frame having a seat and a back comprising: a narrow elongated strap member having a straight, forward seat portion and an upstanding back portion, said back and seat portions connected by an integral curved portion; a spindle plate underlying and seated against the lower face of the forward part of said seat portion of said strap member; said spindle plate having an upwardly extending seat tilting mechanism; said seat having a shell; the forward portion of said strap member being sandwiched between said plate and shell; fastener means passing through both said strap member and said plate for detachably securing both said spindle plate and said strap to said seat shell; that portion of said strap member overlying said plate being bifurcated to provide a central opening for accommodating an upwardly extending portion of said seat tilting mechanism projecting into the plane of said seat portion of the strap; means on said spindle plate forming a pair of tongue tracks, one on each side and extending normal to the axis of said strap member for detachably engaging the end of a pair of arm brackets and holding said ends against fore and aft movement.

7. A chair frame as described in claim 6 wherein the forward ends of said seat portion of said strap member and said plate are substantially in the same vertical plane to provide support bearing between said strap member and plate for substantially the full length of said plate.

* * * * *